US011953287B2

(12) United States Patent
Lin

(10) Patent No.: US 11,953,287 B2
(45) Date of Patent: Apr. 9, 2024

(54) REVOLVING SEQUENTIAL LAUNCHING DEVICE FOR A TOY PROJECTILE LAUNCHER

(71) Applicant: Fiona Lin, Taichung (TW)

(72) Inventor: Fiona Lin, Taichung (TW)

( * ) Notice: Subject to any disclaimer, the term of this patent is extended or adjusted under 35 U.S.C. 154(b) by 0 days.

(21) Appl. No.: 17/953,951

(22) Filed: Sep. 27, 2022

(65) Prior Publication Data

US 2023/0366651 A1 Nov. 16, 2023

(30) Foreign Application Priority Data

May 12, 2022 (TW) ..... 111117905

(51) Int. Cl.
*F41B 7/00* (2006.01)
*F41A 9/35* (2006.01)

(52) U.S. Cl.
CPC ..... *F41B 7/006* (2013.01); *F41A 9/35* (2013.01)

(58) Field of Classification Search
CPC ..... F41B 11/50; F41B 11/51; F41B 11/70; F41B 11/89; F41B 7/006; F41B 7/08; F41A 9/35
USPC ..... 124/56, 59
See application file for complete search history.

(56) References Cited

U.S. PATENT DOCUMENTS

| | | | | | |
|---|---|---|---|---|---|
| 5,343,850 | A * | 9/1994 | Steer | F41B 11/66 | 124/64 |
| 5,535,729 | A * | 7/1996 | Griffin | F41B 11/64 | 124/66 |
| 6,279,562 | B1 * | 8/2001 | Clayton | F41B 9/0018 | 124/59 |
| 7,731,061 | B1 * | 6/2010 | Woodhouse | A63H 33/00 | 446/26 |
| 2007/0101982 | A1 * | 5/2007 | Ong | F41B 11/646 | 124/65 |
| 2009/0064979 | A1 * | 3/2009 | Andrews | F41B 11/89 | 42/54 |
| 2011/0146645 | A1 * | 6/2011 | Ma | F41B 11/54 | 124/66 |
| 2013/0239938 | A1 * | 9/2013 | Nugent | F41B 11/55 | 124/59 |

* cited by examiner

*Primary Examiner* — John E Simms, Jr.
(74) *Attorney, Agent, or Firm* — Burris Law, PLLC

(57) ABSTRACT

A revolving sequential launching device is adapted to be used in a toy projectile launcher. The revolving sequential launching device includes a guide member and a launch unit. The launch unit includes a revolving sleeve having a guide hole, a cam rail subunit disposed on the revolving sleeve, and a plurality of second gas conduits. The cam rail subunit is movable to be in sliding contact with the guide member during movement of the launch unit such that further movement of the launch unit drives rotation of the revolving sleeve. The rotation of the revolving sleeve brings the guide hole to be sequentially aligned with the second gas conduits, thereby discharging sequentially the toy projectiles.

3 Claims, 9 Drawing Sheets

REVOLVING SEQUENTIAL LAUNCHING DEVICE FOR A TOY PROJECTILE LAUNCHER

CROSS-REFERENCE TO RELATED APPLICATIONS

This application claims priority of Taiwanese Patent Application No. 111117905, filed on May 12, 2022.

FIELD

The disclosure relates to a projectile launcher, and more particularly to a revolving sequential launching device utilized in a toy projectile launcher.

BACKGROUND

A conventional toy gun for launching a toy projectile includes a resilient module for launching the toy projectile, a gear component connected to the resilient module, and a trigger connected to the gear unit. The gear component has a toothed portion that engages the resilient module and a toothless portion that does not engage the resilient module.

When the trigger is pulled, the gear component is driven to rotate, and the toothed portion of the gear component compresses the resilient module and creates a restoring force. When the gear component is rotated to have the toothless portion being adjacent to the resilient module and the toothed portion being separated from the resilient module, the resilient module then restores to launch the toy projectile.

However, children may be tired of toy guns that can only fire one projectile at a time with a single trigger and that cannot fire several projectiles in sequence. Thus, variations of new toy guns are being developed.

SUMMARY

Therefore, the object of the disclosure is to provide a revolving sequential launching device utilized in a toy projectile launcher, which can alleviate at least one of the drawbacks associated with the abovementioned prior art.

According to the disclosure, the revolving sequential launching device is adapted to be used in a toy projectile launcher. The toy projectile launcher is loaded with a plurality of toy projectiles. The revolving sequential launching device includes a guide member and a launch unit. The guide member is adapted to be disposed on the toy projectile launcher. The launch unit is movable relative to the guide member along an axis that extends in a front-rear direction. The launch unit includes a front housing, a first gas conduit, a revolving sleeve, a cam rail subunit, a rear housing, and a plurality of second gas conduits. The front housing has a gas storage chamber. The first gas conduit extends rearwardly from the front housing and is in fluid communication with the gas storage chamber. The revolving sleeve is rotatably sleeved on the first gas conduit, and has a guide hole being in fluid communication with the first gas conduit. The cam rail subunit is disposed on an outer surface of the revolving sleeve. The rear housing is mounted on a rear end of the front housing and surrounds the cam rail subunit. The second gas conduits extend rearwardly from the rear housing and are adapted to be directed respectively to the projectiles. The cam rail subunit is movable to be in sliding contact with the guide member during movement of the launch unit along the axis such that further movement of the launch unit along the axis drives rotation of the revolving sleeve. The rotation of the revolving sleeve brings the guide hole to be sequentially aligned with the second gas conduits, thereby discharging sequentially the toy projectiles by gas from the first gas conduit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
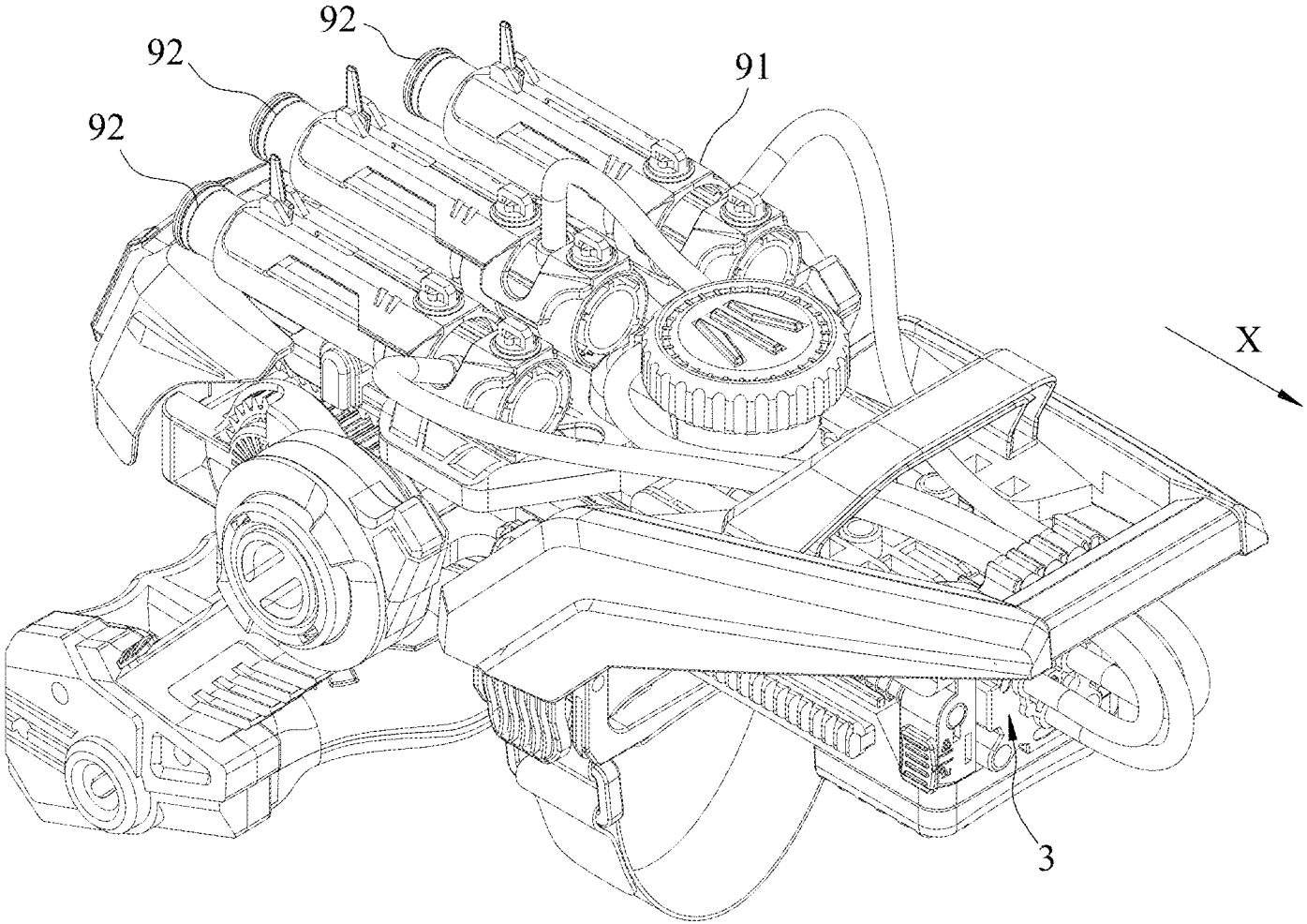
FIG. 1 is a perspective view of a toy projectile launcher mounted with an embodiment of the revolving sequential launching device according to the disclosure and loaded with three toy projectiles.
Figure 2:
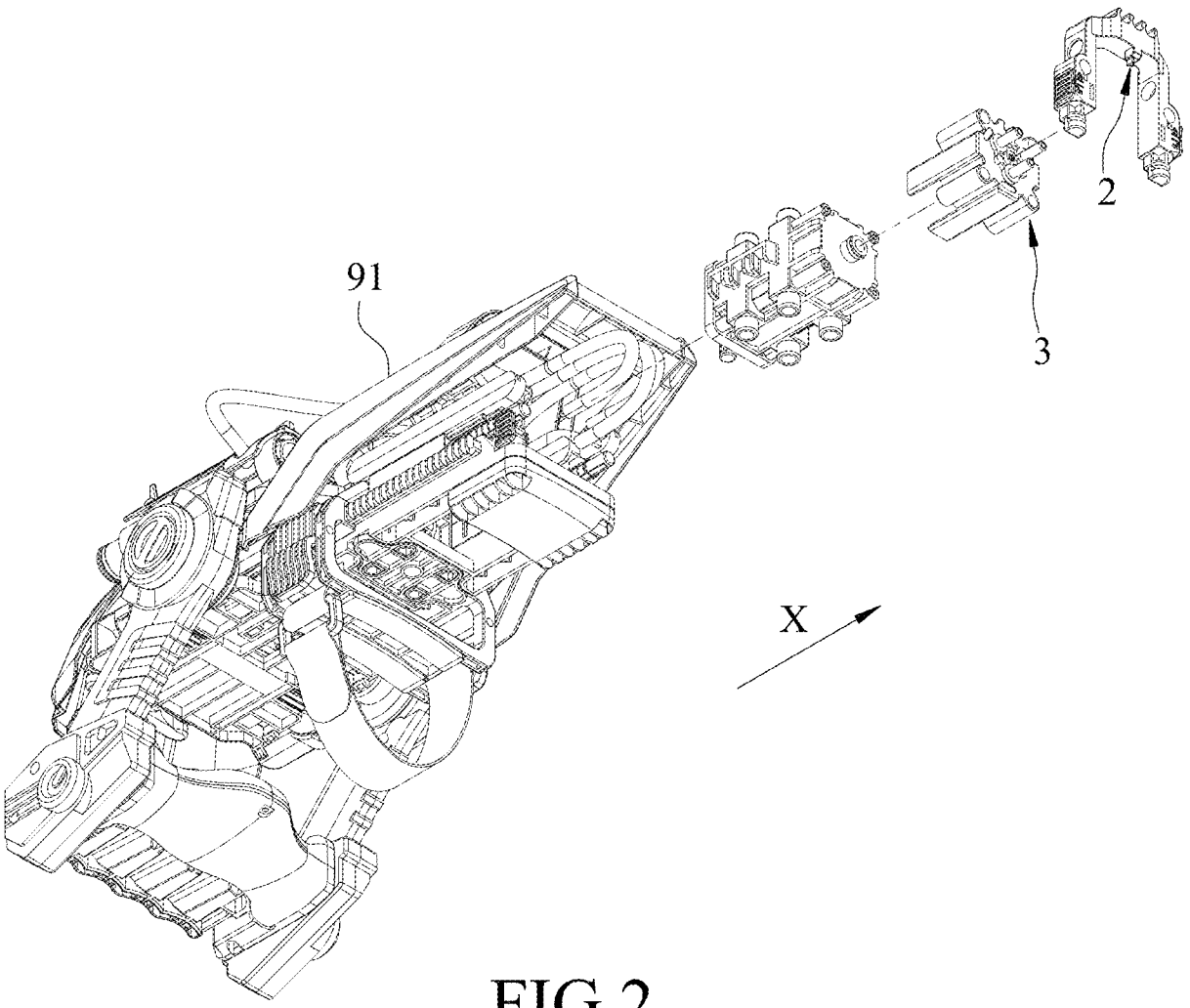
FIG. 2 is an exploded perspective view of the toy projectile launcher.
Figure 3:
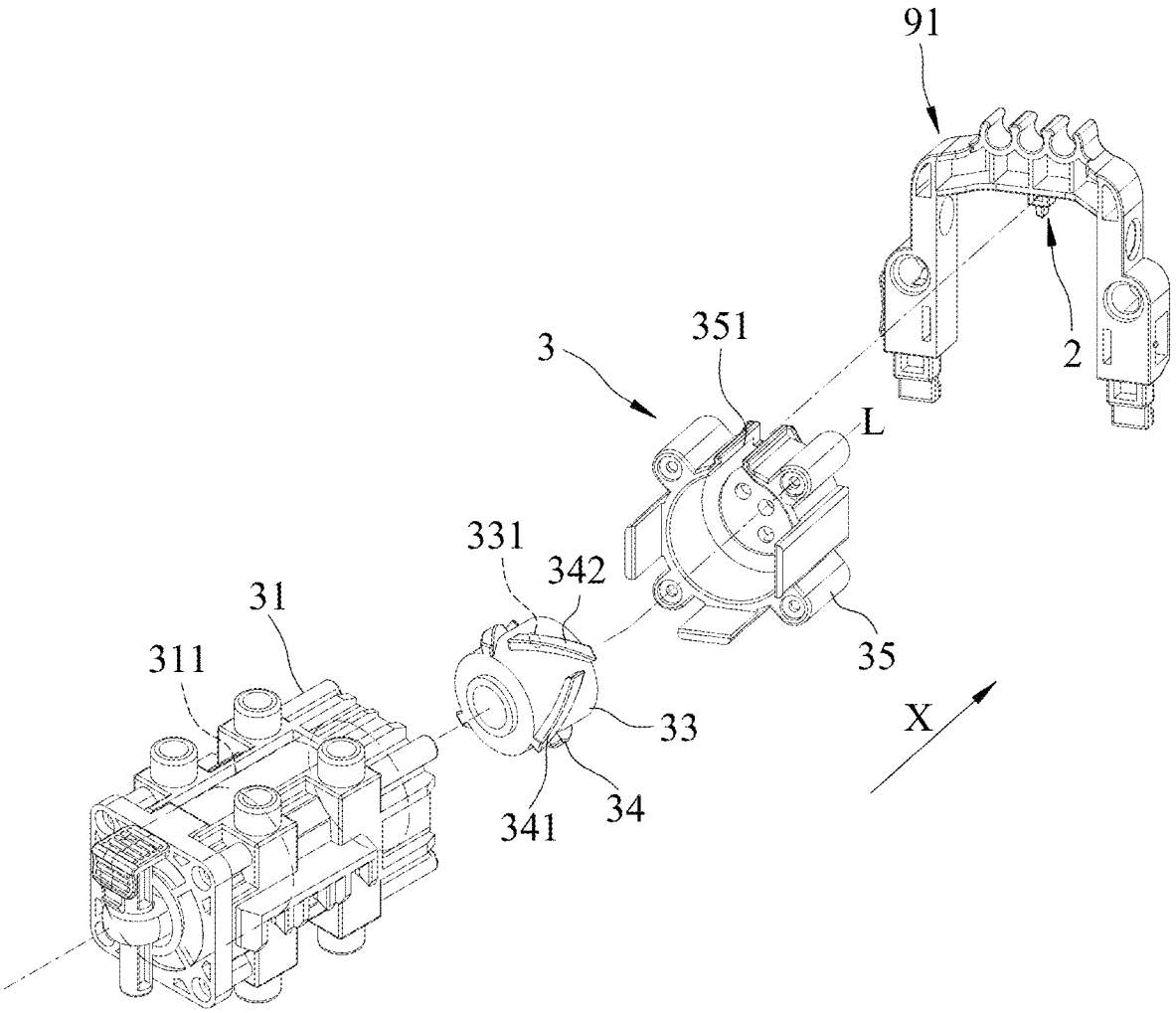
FIG. 3 is an exploded perspective view of the embodiment.

As shown in FIGS. 1, 2, and 3, an embodiment of a revolving sequential launching device according to the present disclosure is adapted to be used in a toy projectile launcher 91 that is loaded with three toy projectiles 92. The revolving sequential launching device includes a guide member 2 and a launch unit 3. In this embodiment, the toy projectiles 92 are, for example, foam darts, and may alternatively be projectiles made of rubber material.

The guide member 2 is adapted to be disposed on the toy projectile launcher 91.

Figure 4:
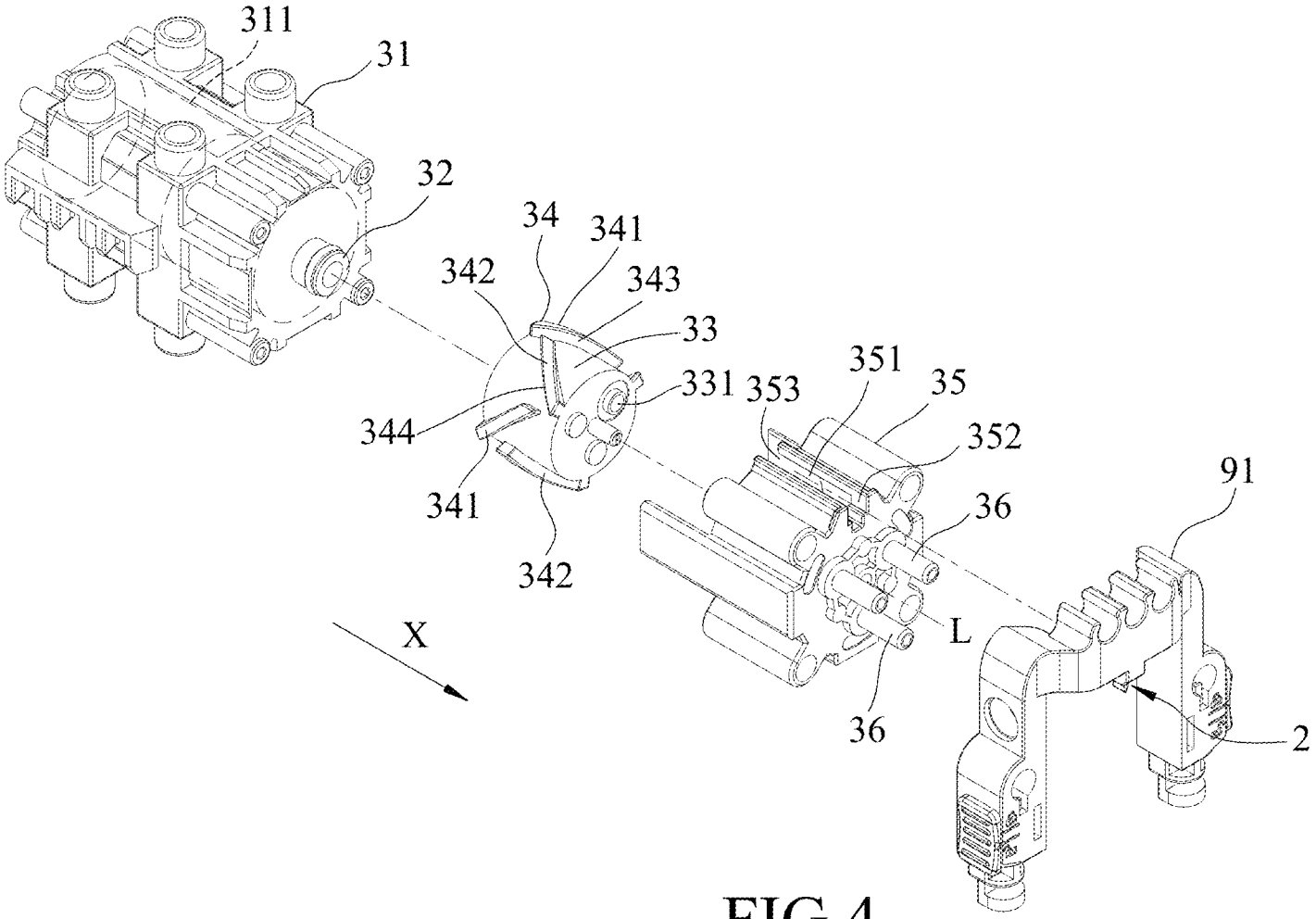
FIG. 4 is an exploded perspective view of the embodiment from another angle.
Figure 5:
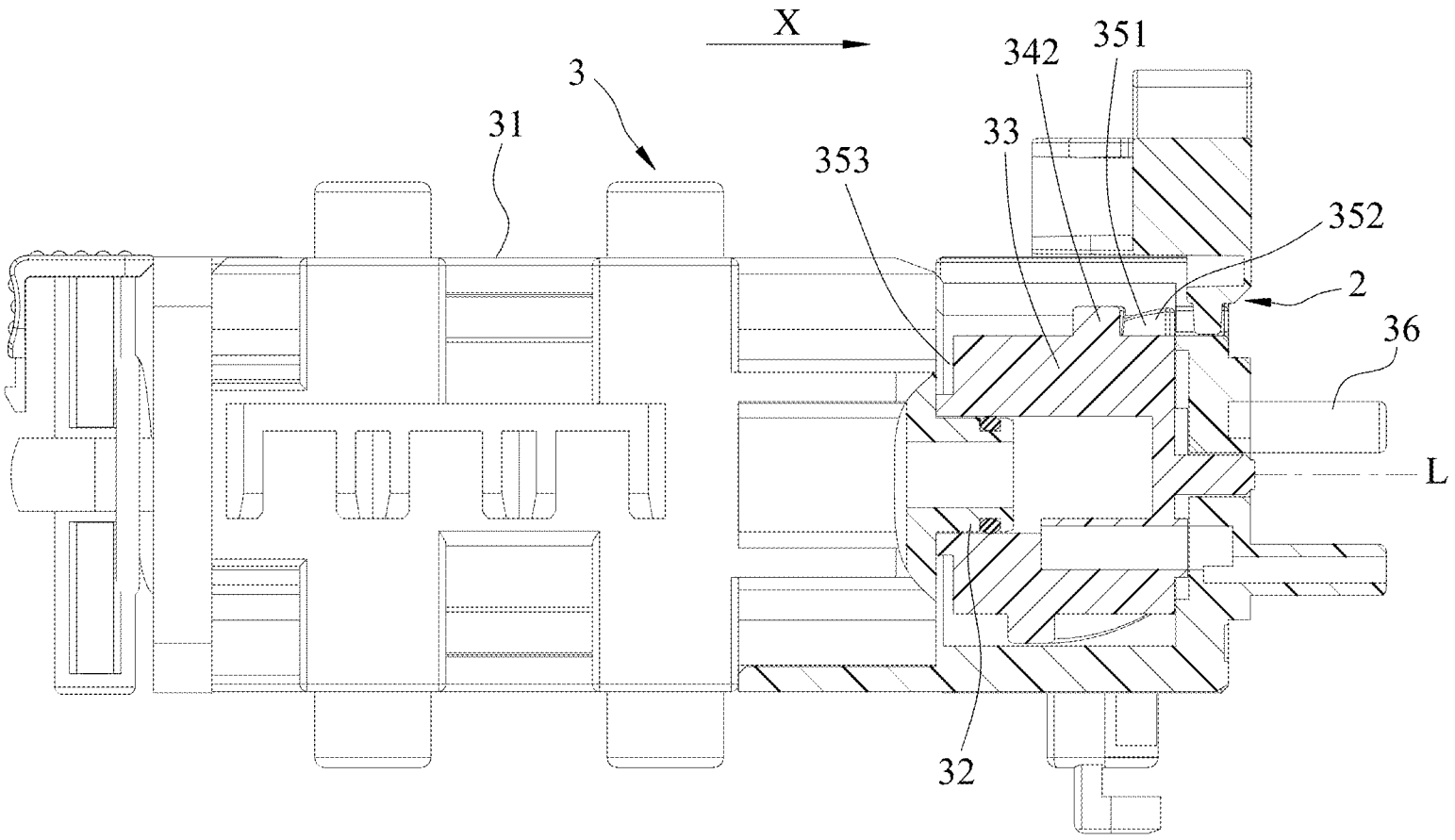
FIG. 5 is a sectional view of the embodiment.

Referring to FIGS. 3, 4, and 5, the launch unit 3 is movable relative to the guide member 2 along an axis (L) that extends in a front-rear direction (X). The launch unit 3 includes a front housing 31 having a gas storage chamber 311, a first gas conduit 32 extending rearwardly from the front housing 31 and being in fluid communication with the gas storage chamber 311, a revolving sleeve 33 rotatably sleeved on the first gas conduit 32, a cam rail subunit 34 disposed on an outer surface of the revolving sleeve 33, a rear housing 35 mounted on a rear end of the front housing 31 and surrounding the cam rail subunit 34, and three second gas conduits 36 extending rearwardly from the rear housing 35 and adapted to be directed respectively to the three toy projectiles 92.

The revolving sleeve 33 has a guide hole 331 that opens rearwardly and that is in fluid communication with the first gas conduit 32.

The cam rail subunit 34 includes three first cam rail bars 341 disposed around the revolving sleeve 33 and angularly spaced apart, and three second cam rail bars 342 disposed around the revolving sleeve 33 and angularly spaced apart. Each of the first cam rail bars 341 has a first cam surface 343 facing obliquely rearward and adapted to be in contact with the guide member 2. Each of the second cam rail bars 342 has a second cam surface 344 facing obliquely forward and adapted to be in contact with the guide member 2.

The rear housing 35 has a guide slot 351 for insertion of the guide member 2 therein. The guide slot 351 has a rear end region 352 and a front end region 353 opposite to each other in the front-rear direction (X). In this embodiment, the revolving sleeve 33 is mounted rotatably to the rear housing 35.

Referring to FIGS. 1, 4, and 5, the cam rail subunit 34 is movable to be in sliding contact with the guide member 2 during the movement of the launch unit 3 along the axis (L) such that further movement of the launch unit 3 along the axis (L) drives the rotation of the revolving sleeve 33. The rotation of the revolving sleeve 33 brings the guide hole 331 to be sequentially aligned with the second gas conduits 36, thereby discharging sequentially the toy projectiles 92 by gas from the first gas conduit 32. Specifically, when the guide hole 331 becomes spatially connected with any one of the second gas conduits 36, the gas from the first gas conduit 32 will be introduced through the second gas conduit 36 to discharge a corresponding one of the toy projectiles 92. In this embodiment, the three second gas conduits 36 are angularly spaced apart with respect to the axis (L).

As the toy projectile launcher 91 operates, the launch unit 3 can switch between a first operation state and a second operation state.

Figure 6:
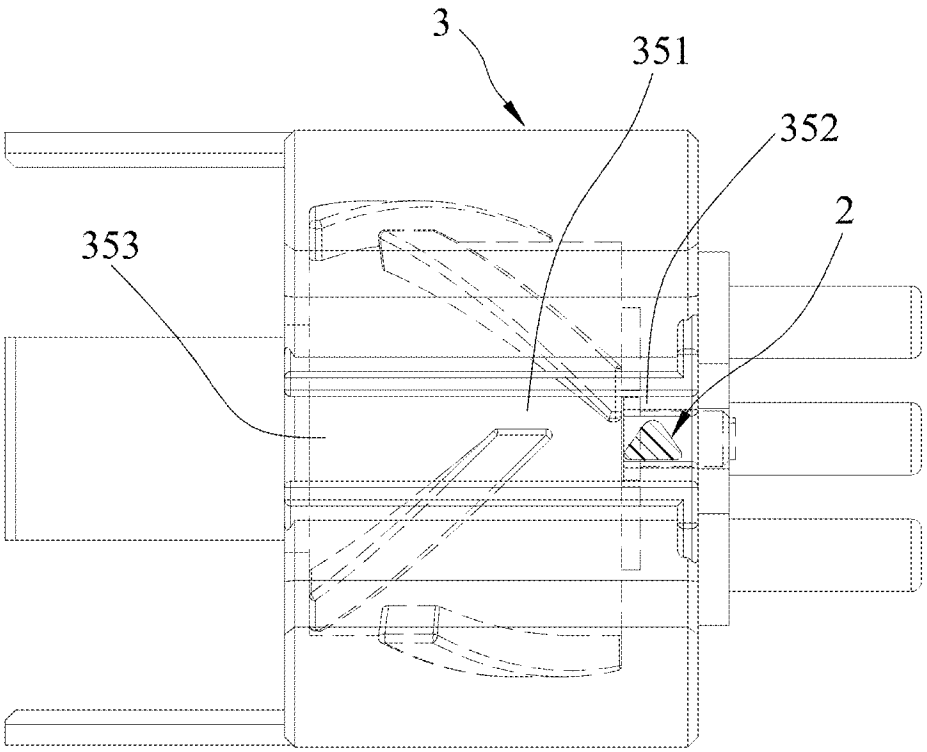
FIG. 6 is a fragmentary partly sectional view of the embodiment, illustrating the launch unit in a first operation state, with a rear end region of a guide slot being adjacent to a guide member.
Figure 7:
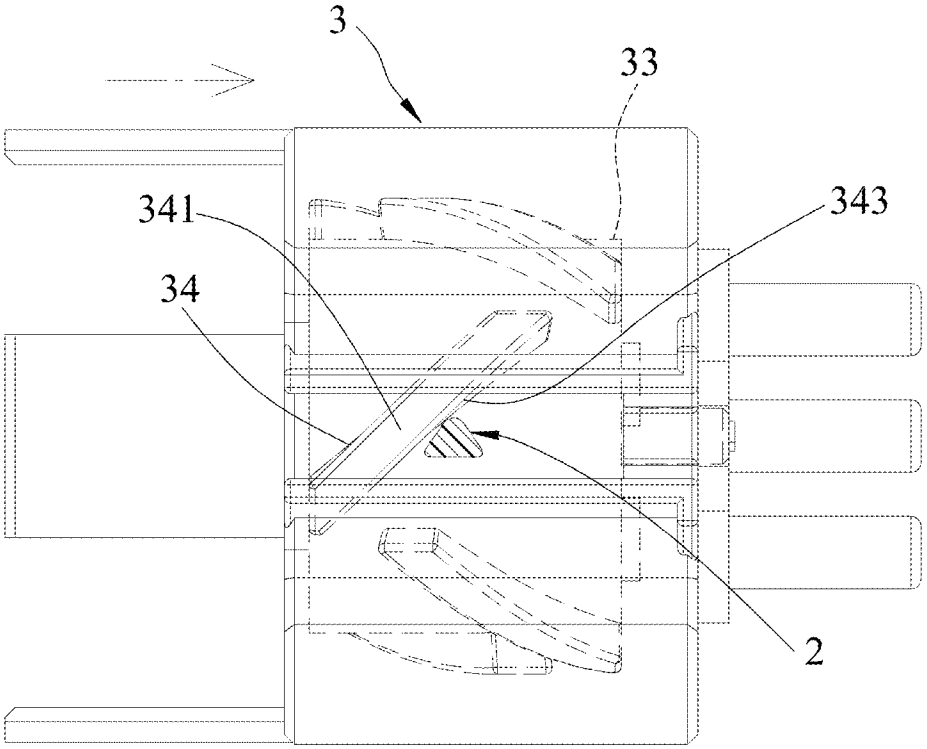
FIG. 7 is a view similar to FIG. 6, illustrating the launch unit being operated from the first operation state toward a second operation state, with a first cam rail bar being in sliding contact with the guide member.
Figure 8:
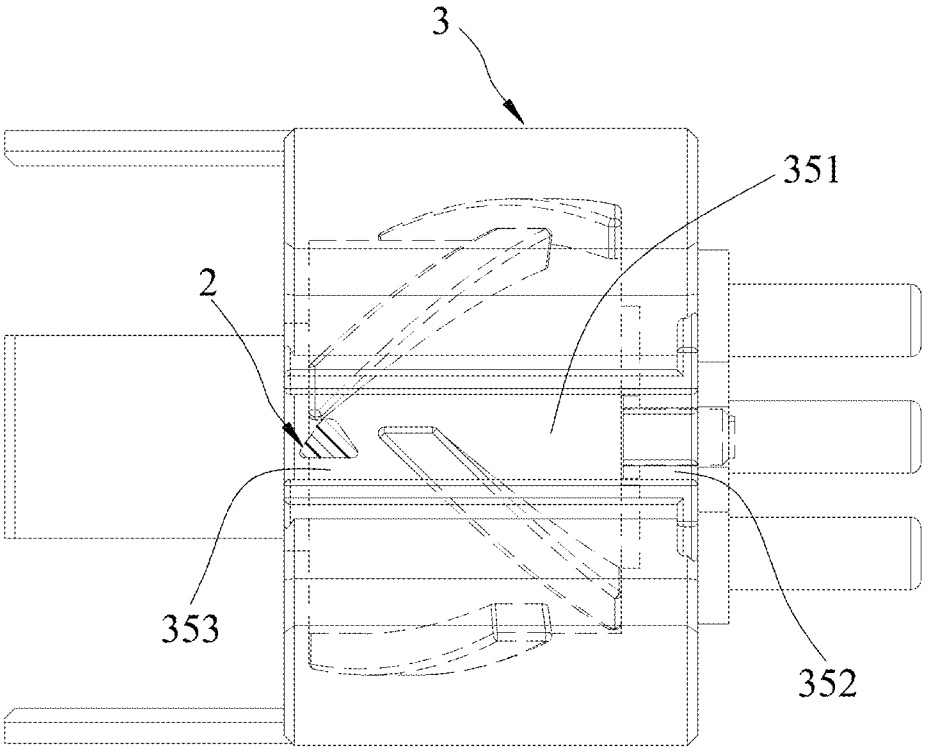
FIG. 8 is a view similar to FIG. 7, illustrating the launch unit in the second operation state, with a front end region of the guide slot being adjacent to the guide member.

Referring to FIGS. 6, 7, and 8, when the launch unit 3 is in the first operation state (see FIG. 6), the rear end region 352 of the guide slot 351 is adjacent to the guide member 2, and the launch unit 3 can be moved rearwardly to insert the guide member 2 into the guide slot 351 via the rear end region 352 and to bring the first cam surface 343 of one of the first cam rail bars 341 to be in sliding contact with the guide member 2. The launch unit 3 can then be further moved rearwardly (see FIG. 7) to drive the rotation of the revolving sleeve 33 in a rotational direction by virtue of the sliding contact between the one of the first cam rail bars 341 and the guide member 2 until the launch unit 3 reaches the second operation state (see FIG. 8), where the front end region 353 is adjacent to the guide member 2.

Figure 9:
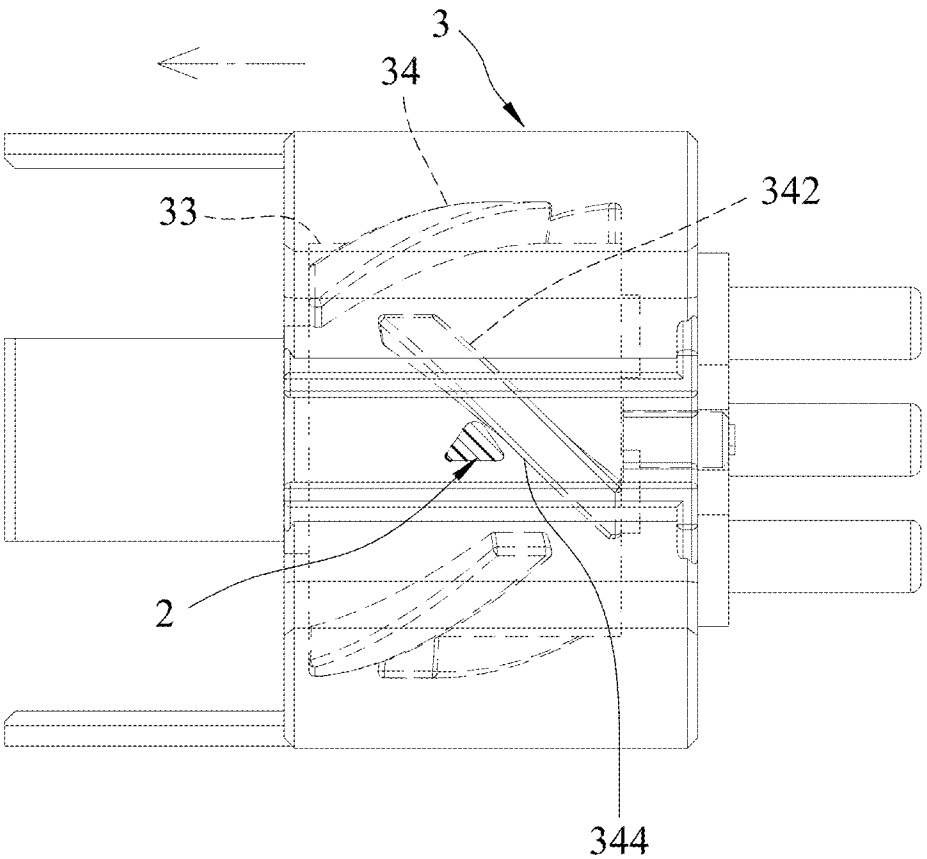
FIG. 9 is a view similar to FIG. 8, illustrating the launch unit being operated from the second operation state toward the first operation state, with a second cam rail bar being in sliding contact with the guide member.

Referring to FIGS. 6, 8 and 9, when the launch unit 3 is in the second operation state, the launch unit 3 can be moved forwardly toward the first operation state. During such movement, the second cam surface 344 of one of the second cam rail bars 342 is brought to be in sliding contact with the guide member 2 and, in turn, causes the revolving sleeve 33 to rotate further in the rotational direction.

Referring to FIGS. 4, 7, and 9, when in use, a user operates the toy projectile launcher 91 to move the launch unit 3 to the first operation state, so that the one of the first cam rail bars 341 is moved against the guide member 2 and the revolving sleeve 33 is driven to rotate in the rotational direction. The guide hole 331 is hence moved to be aligned with one of the second gas conduits 36, allowing the corresponding one of the toy projectiles 92 (see FIG. 1) to be discharged with the gas introduced through that second gas conduit 36. Subsequently, when the user switches the launch unit 3 of the toy projectile launcher 91 to the second operation state, the one of the second cam rail bars 342 is moved against the guide member 2, and the revolving sleeve 33 is driven to rotate further in the rotational direction. The guide hole 331 is then moved to be aligned with another second gas conduit 36 to thereby actuate a discharge of another corresponding one of the toy projectiles 92. The first and second operation states form a cycle of the discharging of the toy projectiles 92. The three toy projectiles 92 can be discharged sequentially by following the cyclic process of the launch unit 3 between the first and second operation states.

In this disclosure, the toy projectile launcher 91 can discharge three toy projectiles 92 in sequence. It is novel and exciting so young players may be attracted.

To sum up, by the arrangement of the guide member 2, the revolving sleeve 33, and the cam rail subunit 34, the gas passing through the second gas conduits 36 can discharge multiple toy projectiles 92 in sequence, which achieves the purpose of the present disclosure.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A revolving sequential launching device adapted to be used in a toy projectile launcher, the toy projectile launcher being loaded with a plurality of toy projectiles, said revolving sequential launching device comprising:

a guide member adapted to be disposed on the toy projectile launcher; and a launch unit being movable relative to said guide member along an axis that extends in a front-rear direction, said launch unit including a front housing that has a gas storage chamber, a first gas conduit that extends rearwardly from said front housing and that is in fluid communication with said gas storage chamber, a revolving sleeve that is rotatably sleeved on said first gas conduit, and that has a guide hole being in fluid communication with said first gas conduit, a cam rail subunit that is disposed on an outer surface of said revolving sleeve, a rear housing that is mounted on a rear end of said front housing and surrounding said cam rail subunit, and a plurality of second gas conduits that extend rearwardly from said rear housing and that are adapted to be directed respectively to the projectiles;

wherein said cam rail subunit is movable to be in sliding contact with said guide member during movement of said launch unit along said axis such that further movement of said launch unit along said axis drives rotation of said revolving sleeve;

wherein the rotation of said revolving sleeve brings said guide hole to be sequentially aligned with said second gas conduits, thereby discharging sequentially the toy projectiles by gas from said first gas conduit;

wherein said rear housing has a guide slot that has a rear end region and a front end region opposite to each other in said front-rear direction;

wherein said launch unit is operable between a first operation state and a second operation state;

wherein when said launch unit is in said first operation state, said rear end region is adjacent said guide member, and said launch unit is rearwardly movable to insert said guide member into said guide slot via said rear end region, and is further rearwardly movable toward said second operation state to drive the rotation of said revolving sleeve in a rotational direction by virtue of the sliding contact between said cam rail subunit and said guide member; and wherein when said launch unit is in said second operation state, said front end region is adjacent to said guide member, and said launch unit is forwardly movable toward said first operation state to drive the rotation of said revolving sleeve in said rotational direction by virtue of the sliding contact between said cam rail subunit and said guide member.

2. The revolving sequential launching device as claimed in claim 1, wherein said cam rail subunit includes a plurality of first cam rail bars disposed around said revolving sleeve and angularly spaced apart from each other, and a plurality of second cam rail bars disposed around said revolving sleeve and angularly spaced apart from each other, each of said first cam rail bars having a first cam surface that faces obliquely rearward and that is adapted to be in contact with said guide member when said launch unit is in said first operation state, each of said second cam rail bars having a second cam surface that faces obliquely forward and that is adapted to be in contact with said guide member when said launch unit guide member is in said second operation state.

3. The revolving sequential launching device as claimed in claim 1, wherein said second gas conduits are angularly spaced apart with respect to said axis.

* * * * *